United States Patent [19]

Langsam

[11] Patent Number: 4,951,032

[45] Date of Patent: Aug. 21, 1990

[54] CRIB RAIL SAFETY ANNUNCIATOR

[76] Inventor: Andrew S. Langsam, 28 Limestone Rd., Armonk, N.Y. 10504

[21] Appl. No.: 366,632

[22] Filed: Jun. 15, 1989

[51] Int. Cl.[5] ..... G08B 21/00

[52] U.S. Cl. ..... 340/686; 340/522; 340/666; 340/573

[58] Field of Search ..... 340/573, 686, 666, 522

[56] References Cited

U.S. PATENT DOCUMENTS 2,734,104 2/1956 Gollhofer ..... 340/686

4,231,030 10/1980 Weiss ..... 340/686

*Primary Examiner*—Glen R. Swann, III

*Attorney, Agent, or Firm*—Andrew S. Langsam

[57] ABSTRACT

A crib rail safety monitor alerts a child's attendant to the potential injurious situation when a child is located within a crib and the crib side rail is in the down or lowered position. Preferably, a flashing light will first alert the attendant to the condition without awakening the child. If, however, the attendant leaves the vicinity of the child's crib, with the child within the crib and the crib side rail lowered, then an audible alarm is activated. The crib rail position indicator can be an ordinary magnetic reed switch, the mechanism to indicate the presence of a child within the crib can be a weight sensor and the attendant's presence or absence can be performed by an ultrasonic motion detector or an infrared temperature sensor. Timers can be electrically interconnected with the components to ensure the child's safety while, at the same time, allowing the attendant the opportunity, before the audible alarm is activated, to remember to raise the crib rail prior to leaving the vicinity of the crib.

33 Claims, 2 Drawing Sheets

CRIB RAIL SAFETY ANNUNCIATOR

BACKGROUND OF THE INVENTION

The present invention relates to a safety or monitoring device for a baby or infant's crib. More specifically, the present invention is an audio and/or visual annunciator for the simultaneous occurence of the crib side rail of a baby's crib left, improperly, in the "down" position with an infant located in the crib. If an infant is of a sufficient size, age or weight such that it has the ability to stand in the crib, then even though the infant may be placed into the crib in a sleeping state, when it awakens after sleep, it could then stand up in the crib and seek to climb out or accidentally fall out of the crib, if the crib side rail is mistakenly left lowered. It is important that the crib rail not be left in the "down" position with a child in the crib. The present invention is a solution to requiring that parents, nurses, child care personnel, etc. necessarily remember to lift the crib side rail to the "up" or safety position. The present invention reminds the child's then-present attendant to raise the crib rail when certain conditions are present.

The present invention, as will be explained, will, however, not awaken the sleeping infant unless it is absolutely necessary for the audible annunciator to do so to draw the attention of the attendant to the unsafe condition that exists, namely, a child is in the crib and the crib rail is in the "down" or lowered i.e., potentially unsafe position and the attendant has left the vicinity of the crib or failed to raise it in a predetermined time after the baby is placed in the crib. According to a preferred embodiment of the present invention the audio annunciator will not sound, even though a baby is in the crib and the crib rail is "down" until after a period of time has elapsed thereby reflecting the probability that the attendant has forgotten to raise the crib rail. Prior to the audible alarm's sounding, a visual alarm can be activated. This preferred time delay between inaudible and audible alarms permits the attendant to place the child into the crib and allow the baby to "settle" into a sleeping mode, first, before the crib rail is mechanically raised (which necessarily has associated noise). The inaudible alarm directs the attendant to the potential problem and if the attendant leaves the crib or fails to raise the side rail within a time period then the audible alarm sounds.

DESCRIPTION OF THE PRIOR ART AND SUMMARY OF THE INVENTION

Cribs are the standard children's furniture for facilitating infant's and toddler's sleeping in a safe and comfortable manner. Towards that end, they have been provided, indeed, required to be provided, by the Consumers Products Safety Commission, with a mechanical two-direction required movement, crib side rail unlocking or lowering device. Basically, the device requires two separate mechanical movements with a minimum of 10 foot pounds of force to unlock or lower the crib rail. This minimum of force and the two separate movements ensures that infants and toddlers themselves can not lower the crib rail, since it is believed that they do not possess the required strength and/or manual dexterity to lift 10 pounds or simultaneously perform two separate mechanical movements. Thus, several mechanisms currently exist for ensuring that the crib rail of an infant's crib can only be dropped or lowered by authorized individuals, namely parents, babysitters, nurses, etc., (hereinafter often referred to as "attendant(s)") and correspondingly that the crib rail not be lowered by unauthorized individuals, namely the children sought to be contained, albeit temporarily, in the crib.

Dropping of the crib rail is often desirable as, for example, when changing the linens of the crib, when placing the infant in the crib and also to remove the child from the crib. As mentioned, a safety device is currently available to ensure that only authorized individuals be capable of dropping the crib rail. Once a baby is placed into the crib, the attendant must remember to raise the crib rail or else the child is at risk of falling or climbing out of the crib. After a baby or infant is placed into the crib, especially if the infant or toddler is asleep, it is absolutely necessary to remember to raise the crib rail back to the "up" or safety position. If this is not done, then when the baby awakens, he or she may stand up in the crib, as baby's are wont to do, and, if the rail is down, the child can fall out of the crib with obvious potential injury and harm. The problem is particularly acute when the infants reach the age and weight corresponding to the minimum ability to stand for a child, for, in the case of a new-born child, even if the crib rail is left in the down position, the child probably does not have the strength or ability to stand and thus it probably can't fall or climb out of the crib. New-borns simply do not pose the significant safety concern that crawling, standing or climbing infants and toddlers do while still sleeping in a crib.

A device which is capable of annunciating the "down" or lowered, i.e., potentially unsafe position of the crib rail is believed to be thus highly desirable. It is not desirable, however, for a crib rail position monitor to indicate that the crib rail is in the "down" position, at all times, but, rather, only if a child is within the crib. If the monitor always indicated an unsafe condition as a simple function of the crib rail being lowered, even if no infant were present in the crib, it would diminish the significance of an alarm signal indicative of a lowered crib rail when an infant is within the crib, a truly potentially injurious condition.

It is believed that a great many crib accident's occur, both reported and unreported, due to the crib rails being left in the lowered or "down" position after a baby is placed in the crib for a nap or a night's sleep. The attendant will generally remember to raise the crib rail of a crib when an awake child is placed in the crib since these children will, if able, try to stand in the crib to "escape" going to sleep. The necessity for crib rail position monitor is thus extremely important when children are placed into the crib in the asleep condition. Here, the attendant could easily forget to raise the rail after gently placing the sleeping child in the crib. The crib rail monitor should not, however, provide an immediate audible signal since that would wake the child.

It is also highly desirable for the crib rail monitor to have a time delay prior to an audible annunciator's being activated since the child attendant, after placing the baby in the crib, may way to wait some period of time prior to raising the crib rail to allow the baby to "settle" into a comfortable sleep state. The movement of the crib rail, if immediately after placing the baby into the crib, may have a tendency to awaken the baby, a clearly undesirable result. In addition, an immediate audible annunciator indicating the presence of a baby and the crib rail in the lowered position would not necessarily indicate that the attendant totally forgot to raise the crib rail, but would certainly awaken and possibly frighten the baby, another result to be avoided. Thus there is a demand for a crib rail safely position monitor which senses the position of the crib rail and, yet, only indicates the lowered or potentially unsafe position of the crib rail if a baby is present in the crib. The monitor is preferably accompanied by a time delay mechanism or, alternately, with an attendant's presence detection device, since the attendant may not have forgotten to raise the crib rail but only wanted to wait some time prior to performing the crib rail lifting operation. If the attendant is still present then it is still possible that the attendant may remember to raise the crib rail. As mentioned, it is undesirable to have an immediate audible annunciator when it is not certain that the attendant forgot to raise the crib rail.

In addition, as can be easily appreciated by parents of young children, many nights sleep are interrupted, in the middle, by the required care of the child. The middle-of-the-night care of an infant or child is not exactly conducted and completed with all of the parent's thoughts directed to the position, after care of the baby, of the crib rail. Many parents have attended to the child's needs and then returned to his or her bed only to later wonder whether he or she remembered to return the crib rail to the "raised" or safety position. This, then, necessitated yet another unpopular trip to the child's room to verify the position of the crib rail or to raise it to the up position. Here, again, a crib rail monitor seems highly desirable.

Today, with so many working mothers, a great number of infants and toddlers are being cared for by child care facilities and, in addition, by child care in the form of nannies living or working in the baby's parent's own homes. One great source of anxiety to the parents is, of course, the safety of the child. By providing a crib rail position alarm, first with a quiet reminder mechanism, in the form of a visual flashing light and then if the monitor detects, for some period of time, the absence of a child attendant, an audible annunciator will be activated which will immediately inform the child care attendant of an unsafe and potentially harmful condition, child injuries, potential for the same and parent's anxiety associated with child care personnel, will all be significantly reduced.

A need is thus presented for a crib rail position annunciator which will alert the child attendant to the unsafe position of the crib rail. However, since mere location of the crib rail in its "down" position, when no child is in the crib is not an unsafe condition and an annunciator of that condition would not only be annoying but, in addition, would diminish the significance of an alarm reflective of a truly unsafe condition, it is an aspect of the present invention to provide a crib rail annunciation device which only provides an alarm signal (visual and/or audible) when the crib rail is in its lowered position and a child is located within the crib.

Many children are fed bottles immediately prior to taking naps or prior to full night's sleep. Many of these children fall asleep in the parent's arms. The parent's then walk over to the crib to place the child within. This is attempted to be done quite carefully since the desired object is to not arouse the child from sleeping. Thus, after the child is first placed into the crib, the parent may wait a little amount of time until the child seems comfortable in the crib and then slowly and quietly, the parent raises the crib rail to the "up" or safety position. Certain parents, in their desire not to awaken the child by creating noise may tend to forget raising the crib rail. This, however, can have potentially harmful effect, should the child later awaken, with the crib rail down. Thus, there exists a need for a crib rail annunciator which senses the presence of an attendent (parent, babysitter, nurse, child care person, etc.) and if the presence is detected, then no annunciation is provided. Once the device detects, simultaneously, the presence of a child in the crib, the crib rail is "down" and the absence of an attendent's presence (or a period of time has elapsed without the crib rail being raised), then an audible signal is generated. While this may waken the otherwise sleeping child, it is deemed preferably to do so then to have the baby awaken with the crib rail "down" whereby the child can fall out of the crib.

It is an object of the present invention to provide a device which will alert a child attendant to the dangerous condition of a child being in a crib with the crib rail in the down or lowered position. Preferably, this condition is indicated by an inaudible yet easily seen flashing light. This is to heighten the child attendant's awareness of a potentially dangerous situation and, yet, an audible alarm would unnecessarily awaken the child. It is necessary to provide an audible alarm only when the crib rail is "down" or in the unsafe position, an infant is in the crib, and either no attendant is sensed by the monitor or a minimum period of time has elapsed—indicating that there is a high probability that the attendant forgot to raise the crib rail.

It is an object of the present invention to provide an electro-mechanical device which will alert a child attendant to the dangerous condition of a child being in a crib with the crib rail in the down or lowered position.

It is an object of the present invention to provide a crib rail monitor or annunciator device which will not emit a signal that the crib rail is down or lowered, even if that is the fact, if no child is within the confines of the crib.

It is an object of the present invention to provide a crib rail annunciator which will provide, in the preferred embodiment, a visual signal indicating that the crib rail is down, when a child is located within the crib, but no audible signal unless either or both the monitor detects a passage of time reflective of forgetting to raise the crib rail or the absence of a child attendant in the vicinity of the crib.

It is an object of the present invent to provide a device which determines the presence of a child within the crib by a simple weight sensing device. Preferably, the weight sensor can be selectively adjusted to compensate for the various weights of different mattresses, crib bumbers, crib toys, etc.

It is an object of the present invention to provide a crib rail annunciator which has the ability to sense the presence of a child attendant within the immediate area of the crib and to provide a visual signal if the crib is in its "down" position, with a child within the crib, and to change the signal to an audible signal if, within a certain period of time the crib rail is not moved to the "up" or safety position. Alternatively, if the presence of an attendant is detected by the device, the audible signal is blocked until the attendant has left the vicinity of the room, for a predetermined period of time and thus clearly failed or forgotten to raise the crib rail.

These and other objects are desirably accomplished by the present invention. The important aspects, however, are to provide a crib side rail "down" position alerting device which does not provide "nonsense"

signals, as, for example, when there is no child within the crib; which does not unecessarily awaken a sleeping child before a diligent attendant has decided to raise the crib rail and yet deliberately waited a period of time before raising the crib rail; which allows the attendant the opportunity to place the child within the crib, allow the child to assimilate, if sleeping already, into the crib, and then after a certain time period, first provide a visual non-sleep intrusive signal indicating the possibility of an unsafe condition, and if the child is left unattended for a certain time period and/or should the presence of an attendant be undetected (the attendant's absence is detected) then an audible signal would be activated.

It is also an aspect of the present invention to provide a resettable timing mechanism in conjunction with the attendant presence detector so that if the presence of an attendant is detected in the vicinity of the crib then a timing reset will occur. Thus the audible alarm will not operate unless the presence of an attendant is undetected for a predetermined period of time.

DETAILED DESCRIPTION OF THE DRAWINGS AND THE PREFERRED EMBODIMENT OF THE INVENTION

Figure 1:
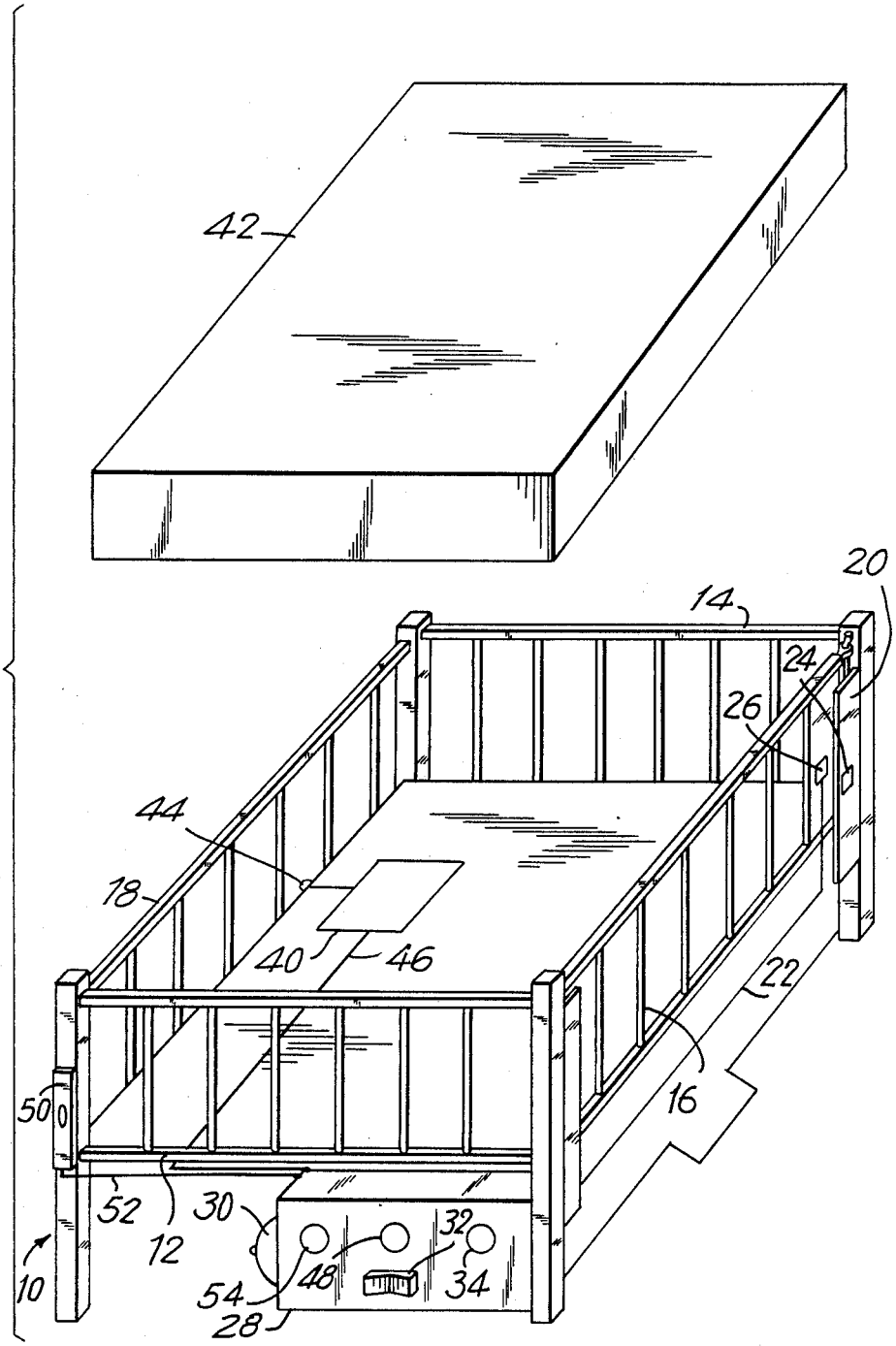
FIG. 1 is a basic perspective and exploded drawing of a crib rail alarm system constructed according to the preferred embodiment of the present invention.

As best seen in FIG. 1, an ordinary baby's crib 10 is provided with two end walls 12 and 14 and two side located crib rails 16 and 18. Today, it is quite common for the two crib side rails to both be capable of being selectively dropped. Dropping or lowering of the crib side rails 16, 18 is done for facilitating the placement of a child into the crib, for removing a child from the crib, or for changing the linens of the crib. The crib side rails, however, to ensure that a child does not accidentally fall out of the crib or, in the case of larger children, to ensure that the child does not climb out or let himself out of the crib must be raised after the desired operation has been performed on the crib, i.e. changing of linens, placement of a child or removing a child.

As has been previously explained, today, by rule of the Consumers Products Safety Commission, the ability to drop the side rail is intended to be limited to authorized individuals, i.e., those with sufficient strength to lift 10 pounds and the manual dexterity to perform two simultaneous mechanical operations. There are many different mechanisms on the market today for accomplishing that side rail safety feature. They form no part of the present invention.

Attached, fixedly to the fixed portion 20 of the crib 10, adjacent to one side rail 16 (for illustration purposes, only one side rail is equipped with the sensor although both side rails 16 and 18 can be equipped as when both side rails are to be raised and lowered) is a position sensor 24. Located on the vertically reciprocable side rail 16, in opposing relation to the position sensor 24 is a crib rail sensor 26. The position sensor 24 and crib rail sensor 26 can be readily and commercially available window security sensors as are currently available for home security systems. Basically, if the position sensor 24 and the crib rail sensor 26 are aligned, when the crib rail is in the raised position, no electrical signal indicative of a potentially dangerous situation will be emitted. On the other hand, if the side rail is dropped, thereby moving the crib rail sensor 26 out of alignment with the position sensor 24, an electrical signal reflective of a potentially dangerous situation is generated. The position sensor is electrically connected by wires 22 to an electrical box 28. Again, the components of the crib rail safety monitor of the present invention are readily available and most easily obtainable from technology now used in home security systems. A circuit designed around a magnetic-reed switch is probably the best choice in terms of simplicity, low cost and dependability for sensors 24 and 26.

An electrical box 28 is located beneath or attached to the crib 10. Preferably, the box 28 is located beneath one of the fixed end walls 12 or 14 of the crib. This can be easily accomplished by attaching by use of ordinary screws, the box 28 to one of the legs of the crib. The box is intended to be partially hidden from view to minimize the unaesthetic aspects of the invention in an infant's sleeping area; nevertheless, the box must be accessible for maintenance and, in addition, since a light will flash due to the simultaneous occurrence of a side rail being down and a child located in the crib, the lights and other indicators on the box must be easily visible or, at least, the lights must be detectible, if flashing.

The box 28 houses appropriate batteries to electrically drive the monitoring device. In addition, the box houses the appropriate electronic circuitry and logic so that the system operates as described. Also, the electrical box houses (or, alternatively, has attached to its exterior, as indicated by 30) an audible alarm. If desired the alarm can be a music box or a prerecorded voice stating, for example "Danger, the crib rail is down! Raise the crib rail for safety." The electrical box 28 is also provided with an "on-off" switch 32. The switch allows the system to be activated for use and, yet, when the system is to be stored for long periods or no longer required, as, for example, when the child still sleeps in a crib and yet, can easily climb into and out of the crib and no danger is present by having a lowered side rail. Clearly, however, the on-off switch 32, while the system is intended to be used as when the baby's safety is dependent on the operation of the crib rail monitor, should be in the "ON" position. Since the unit draws very little power on "standby", it is expected that the system will only be turned "OFF" or disabled while it will be dormant for an extended period. A first Light Emitting Diode 34 (LED) colored green should be electrically connected to the circuitry of the system. When the power supply is adequate to control and monitor the position of the side rail of the crib, the colored green light 34 will be "ON". If, however, the power of the batteries is not adequate (or an irregular power condition exists) to monitor the position of the side rail of the crib, then green light 34 will flash, "ON and OFF", to indicate to the attendant that the batteries need recharging or replacing. When the system is disabled by turning the switch to "OFF" none of the LEDs, including 34, are illuminated.

Figure 2:
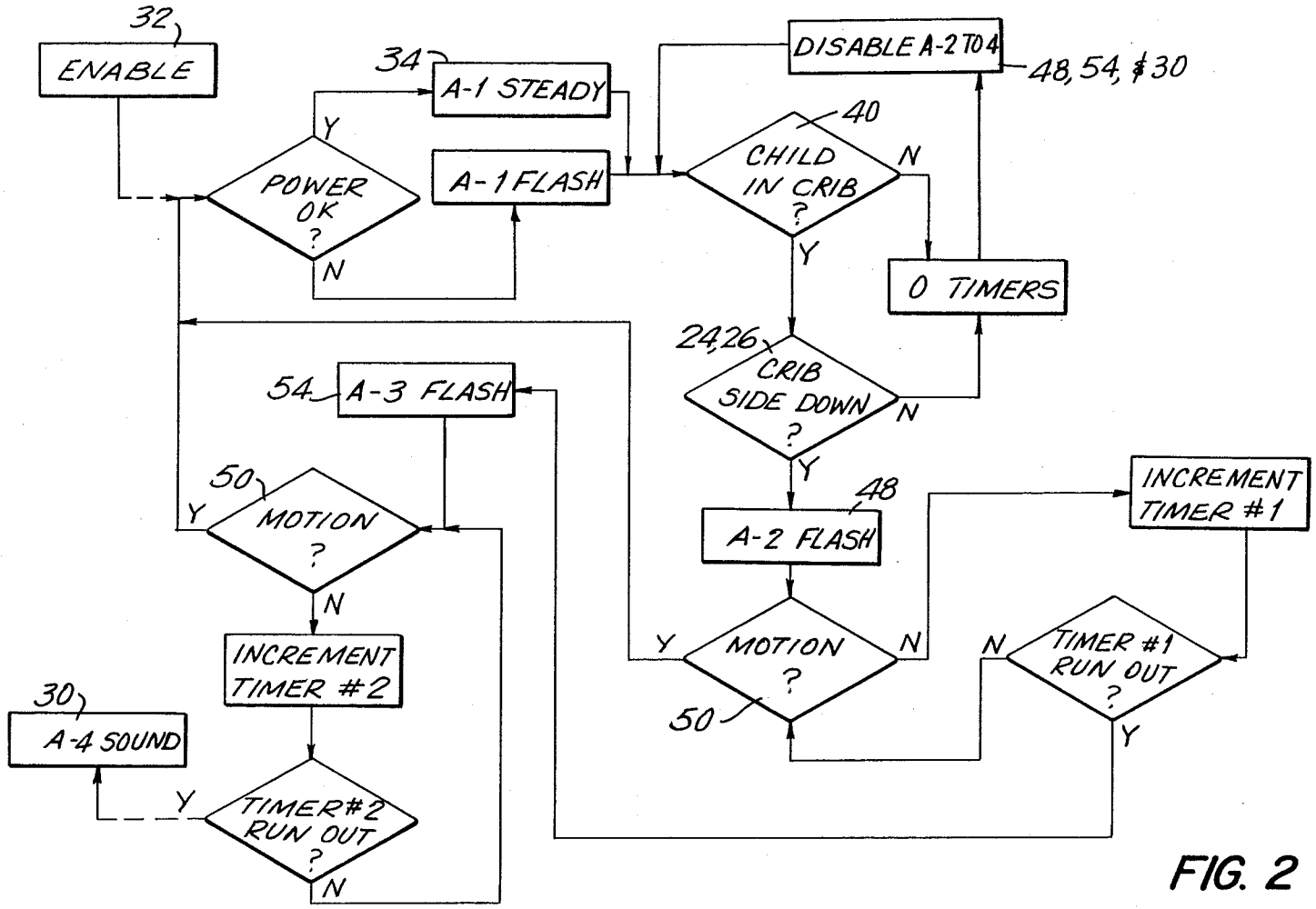
FIG. 2 is a diagramatic flow chart of the electromechanical circuitry of the preferred embodiment of the crib alarm system of the present invention.

An infant's presence sensor 40, preferably a weight detector is positioned beneath the mattress 42 of the crib. The weight sensor is also a readily available electrical component. Preferably, the weight sensor is designed around a pressure sensing switch. The person responsible for originally connecting the monitoring system to the crib can rotate a simple control knob 44 to null the sensor of the circuit, with mattress, blankets, toys, etc. in place. This would accomodate variation of toys located in the crib, weight of the mattress and crib bumpers, etc. Thus an electrical signal would only be produced and transmitted by wires 46 as a function of the additional weight exerted on the weight sensor 40, a pressure sensing switch, by the location of a child on the mattress. This, then, indicates the presence of an infant in the crib. If a child is not sensed in the crib by the subassembly noted in the flow chart (FIG. 2) as "Child in Crib", essentially no further system activity occurs. However, should a child be located in the crib, as detected by the child's presence detector (preferably, the weight sensor) then the electronics of the system uses the subassembly noted in the flow chart as "Crib Side Down" (the crib position indicating means) to determine if both conditions exist simultaneously.

If both a child in the crib is detected and the crib side rail is in the "down" position, as sensed by the respective sensors, a red LED light (A-2) in the flow chart, element 48 on electrical box 28 flashes. This alerts the attendant that a potentially dangerous situation, if left unattended, exists. Yet, since the attendant is presumed still present, because the timer has not "timed out" or because the presence of an attendant is detected (detailed below) the monitor merely flashes a light, the red LED, rather than the more serious, and potential baby awakening sounding of the audible alarm 30.

To determine the presence or absence of attendant supervision, an ultrasonic or infrared detection mechanism 50 can be employed. It is electrically connected to the monitor by wires 52. The ultrasonic detector could also be secured to the legs of the crib and would detect a doppler shift in the echo returned from objects in the vicinity of the crib sought to be surveilled. The infrared detector, on the other hand, would detect changes in heat patterns. Independent of which of the sensor are used, they are generally designed to detect the presence of an individual in the vicinity of a crib. Nevertheless, with the proper electrical circuitry and interfaces, these sensors can be electrically connected to provide signals reflective of the absence of supervision.

As seen in the flow chart (FIG. 2), a detect time lag electrical component is also electrically connected into the preferred embodiment of the present invention. This component is also readily available. It would be housed in box 28. It is intended to detect the occurrence of the other preceeding conditions, without remedy, i.e., without either removing the infant from the crib or raising of the crib rail, for an extended period of time. A variety of electronic timing chips and circuits are commercially available to fulfill such timing requirements. Here, too, resort to home security electronic circuitry provides suitable such timing devices.

As mentioned, if both the child's presence is detected, by the weight sensor 40, and the crib side rail is "down", as sensed by the crib detect sensor 24, 26, the electrical circuitry then searches for a determination of the presence of attendant supervision by resort to the ultrasonic or infrared sensors. At this point, however, the red LED flashes to alert the attendant to the potential dangerous situation. The search for attendant's presence then occurs. This involves the electrical subassembly titled "MOTION" in the flow chart. This circuit determines whether or not there has been motion (the signal of an attendant) in the vicinity of the crib, before timer #1 (see the flow chart) reaches a predetermined count, i.e., before the timer "times out." If motion, hence, an attendant's presence is detected within this time limit, timer #1 is reset to "0" and restarted. If no motion, again, reflective of the absence of an attendant, is detected, a flashing visual annunciator, in the form of LED 54, this time, white incandescent, is activated and timer #2 is started (see flow chart). If motion ( an attendant) is detected before timer #2 "times out", then the white incandescent LED, element 44, in FIG. 1, is shut off and the two timers, #1 and #2 are reset and zeroed. The red light 48 still flashes. If, however, timer #2 does "times out", as determined by the assembly on the flow chart noted as "TIMER #2 RUN-OUT", an audible annunciator, preferably bell 30, a music box or even an electronic voice "chip" is energized. As previously mentioned, the voice recording could alert the attendant to the potentially dangerous condition and advise the attendant how to correct the condition by merely raising the crib side rail. In an alternate embodiment, the audible alarm can be located remote from the monitor so that even though it provides an audible signal, the baby will not be startled or awakened by the sound.

The above specification and the detailed description of the preferred embodiment are to be considered as representative, only, as the scope of the invention to which I am entitled, is intended to be covered by the scope of the claims, as interpreted by the Courts, and their reasonable and legal equivalents, as also interpreted by the Courts and the applicalbe statutes.

I claim:

1. A crib rail safety monitor mechanism comprising:

(a) a crib rail position detecting means for determining the raised or lowered position of a crib side rail and providing a first signal reflective thereof, (b) a child's crib-presence detecting means for determining the presence or absence of a child in said crib and providing a second signal reflective thereof, and (c) crib attendant alerting means for alerting an attendant of said child that said crib side rail is the lowered position, said alerting means only being responsive to both said first signal, if reflective of a lowered position of said cribe side rail, and said second signal, if reflective of the presence of a child in said crib.

2. A crib rail safety monitor mechanism as claimed in claim 1, wherein:

said first and said second signals are electrical.

3. A crib rail safety monitor mechanism as claimed in claim 2, further comprising:

power means for electrically driving said crib rail position detecting means, said child's crib-presence detecting means and said crib attendant alerting means, and an on-off switch electrically connected to said power means.

4. A crib rail safety monitor mechanism as claimed in claim 1, wherein said crib rail position detecting means comprises a magnetic reed switch.

5. A crib rail safety monitor mechanism as claimed in claim 1, wherein said child's crib-presence detecting means comprises a weight sensor

6. A crib safety monitor mechanism as claimed in claim 5, wherein:

said weight sensor can be adjusted to null the weight of the crib mattress and other objects located thereon.

7. A crib rail safety monitor mechanism as claimed in claim 1, wherein:

said crib attendant alerting means comprises an audible alarm.

8. A crib rail safety monitor mechanism as claimed in claim 7, wherein:

said audible alarm is a music generating means.

9. A crib rail safety monitor mechanism as claimed in claim 7, wherein:

said audible alarm is a prerecorded message.

10. A crib rail safety monitor mechanism as claimed in claim 1, wherein:

said crib attendant alerting means comprises an inaudible alarm signal.

11. A crib rail safety monitor mechanism as claimed in claim 10, wherein:

said inaudible alarm signal is a flashing light.

12. A crib rail safety monitor mechanism as claimed in claim 10, wherein:

said crib attendant alerting means further comprises an audible alarm; and a timer delay is electrically interposed between said inaudible alarm signal and said audible alarm.

13. A crib rail safety monitor mechanism as claimed in claim 1, wherein:

said crib attendant alerting means is located remote from the vicinity of said crib.

14. A crib rail safety monitor mechanism as claimed in claim 1, further comprising:

attendant presence detecting means for determining the presence or absence of an individual proximal to said cribe and providing a signal reflective thereof, said attendant presence detecting means blocking said crib attendant alerting means when an individual's presence is detected.

15. A crib rail safety monitor mechanism as claimed in claim 14, wherein:

said attendant presence detecting means is an ultrasonic motion detector.

16. A crib rail safety monitor mechanism as claimed in claim 14, wherein:

said attendant presence detecting means is an infrared temperature sensor.

17. A crib rail safety monitor mechanism as claimed in claim 14, wherein:

said attendant presence detecting means is provided with a timer means, and said timer means serves to temporarily block said crib attendant alerting means until said attendant presence detecting means determines the absence of an individual in the vicinity of said crib for a predetermined time period.

18. A safety monitor mechanism for a vertically movable side rail adjacent to a resting surface comprising:

(a) a side rail position detecting means for determining the raised or lowered position of said side rail and providing a first signal reflective thereof;

(b) a person's presence detecting means for determining the presence or absence of a person on said resting surface and providing a second signal reflective thereof; and (c) attendant alerting means for alerting an attendant for the resting surface that the side rail is in the lowered position, said alerting means only being responsive to both said first signal, if reflective of a lowered position of said side rail and said second signal, if reflective of the presence of an individual on said resting surface.

19. A safety monitor mechanism as claimed in claim 18 wherein said first and said signals are electrical.

20. A safety monitor mechanism as claimed in claim 19 futher comprising power means for electrically driving said rail position detecting means, said person's presence detecting means and said attendant alerting means; and an on-off switch electrically connected to said power means.

21. A safety monitor mechanism as claimed in claim 18 wherein said side rail position detecting means comprises a magnetic reed switch.

22. A safety monitor mechanism as claimed in claim 18 wherein said person's presence detecting means comprises a weight sensor.

23. A safety monitor mechanism as claimed in claim 22 wherein said weight sensor can be adjusted to null the weight of the mattress and other objects but not a person's weight located on said weight sensor.

24. A safety monitor mechanism as claimed in claim 18 wherein said attendant alerting means comprises an audible alarm.

25. A safety monitor mechanism as claimed in claim 24 wherein said audible alarm is a pre-recorded message.

26. A safety monitor mechanism as claimed in claim 18 wherein said attendant alerting means comprises an inaudible alarm signal.

27. A safety monitor mechanism as claimed in claim 26 wherein said inaudible alarm signal is a flashing light.

28. A safety monitor mechanism as claimed in claim 26 wherein said attendant alerting means further comprises an audible alarm, and a timer delay is electrical interposed between said inaudible alarm signal and said audible alarm.

29. A safety monitor mechanism as claimed in claim 18 wherein said attendant alerting means is located remote from the vicinity of said resting surface.

30. A safety monitor mechanism as claimed in claim 18, further comprising attendant presence detecting means for determining the presence or absence of an individual proximal to said resting surface and providing a signal reflective thereof, said attendant presence detecting means blocking said attendant alerting means when an individual's presence is detected.

31. A safety monitor mechanism as claimed in claim 30 wherein said attendant's presence detecting means is an ultrasonic motion detector.

32. A safety monitor mechanism as claimed in claim 30 wherein said attendant's presence detecting means is an infrared temperature sensor.

33. A safety monitor mechanism as claimed in claim 30 wherein said attendant's presence detecting means is provided with a timer means, and said timer means serves to temporarily block said attendant's alerting means until said attendant's presence detecting means has determined the absence of an individual proximal to said resting surface, for predetermined period of time.

* * * * *